United States Patent [19]

Yanagawa et al.

[11] Patent Number: 4,474,453

[45] Date of Patent: Oct. 2, 1984

[54] ELECTROSTATIC COPYING APPARATUS

[75] Inventors: Nobuyuki Yanagawa; Masao Hosaka, both of Tokyo, Japan

[73] Assignee: Ricoh Company, Ltd., Tokyo, Japan

[21] Appl. No.: 140,374

[22] Filed: Apr. 14, 1980

[30] Foreign Application Priority Data

Apr. 18, 1979 [JP] Japan ..... 54-46715
Jul. 9, 1979 [JP] Japan ..... 54-85964

[51] Int. Cl.³ ..... G03G 15/00

[52] U.S. Cl. ..... 355/14 C; 355/14 R; 355/70

[58] Field of Search ..... 355/1, 7, 8, 14 D, 14 E, 355/14 C, 14 R, 67, 68, 69, 70

[56] References Cited

U.S. PATENT DOCUMENTS

| | | | |
|---|---|---|---|
| 3,639,058 | 2/1972 | Kimura | 355/68 X |
| 3,955,888 | 3/1976 | Kakiuchi et al. | 355/1 |
| 4,008,954 | 2/1977 | Ogawa et al. | 355/1 |
| 4,129,373 | 12/1978 | Ogura et al. | 355/1 |
| 4,172,659 | 10/1979 | Laska | 355/68 |
| 4,193,679 | 3/1980 | Mochizuki et al. | 355/1 |
| 4,200,391 | 4/1980 | Sakamoto et al. | 355/14 D X |
| 4,239,374 | 12/1980 | Tatsumi et al. | 355/14 D X |
| 4,255,042 | 3/1981 | Armitage, Jr. et al. | 355/1 X |
| 4,256,401 | 3/1981 | Fujimura et al. | 355/14 C X |

FOREIGN PATENT DOCUMENTS

| | | | |
|---|---|---|---|
| 2415390 | 10/1974 | Fed. Rep. of Germany | 355/3 R |
| 2854448 | 6/1979 | Fed. Rep. of Germany | 355/14 D |

OTHER PUBLICATIONS

"Erase Lamp Control", T. T. Underhill; IBM Disclosure, vol. 19, No. 2, Jul. 1976, pp. 393-394.

*Primary Examiner*—J. V. Truhe
*Assistant Examiner*—Richard M. Moose
*Attorney, Agent, or Firm*—David G. Alexander

[57] ABSTRACT

The optical density pattern of an original document (26) is sensed during scanning movement for radiating a light image of the document (26) onto a photoconductive belt (27) which is held stationary during the scanning. Operating parameters of the apparatus (21) which are to be controlled after completion of scanning are computed as functions of the sensed pattern. Copy sheets of different sizes are provided, and the copy sheet size is selected to be equal to the sensed width of the document (26). Illumination lamps (37) are selectively energized to discharge non-image portions of the belt (27) between scanning and developing in accordance with the sensed dimensions of the document (26). A developing bias voltage is controlled in accordance with sensed document density and contrast.

18 Claims, 16 Drawing Figures

Fig. 2
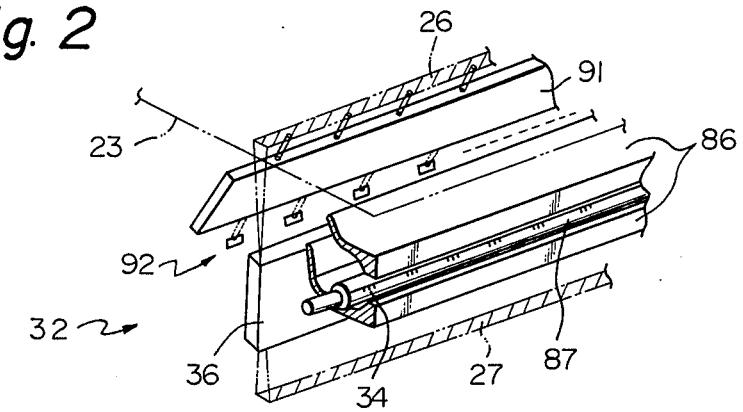
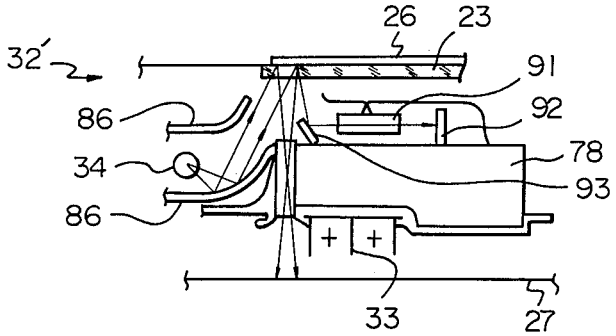
Fig. 3
Fig. 4
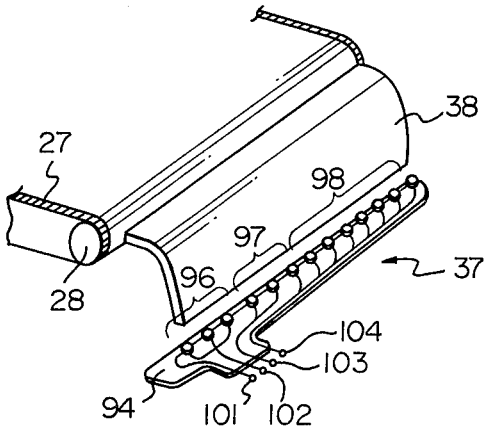

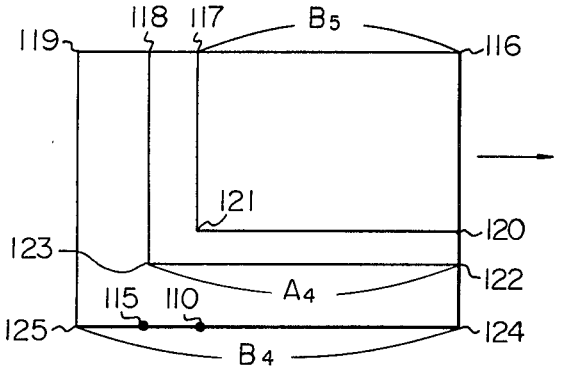
Fig. 8
Fig. 9
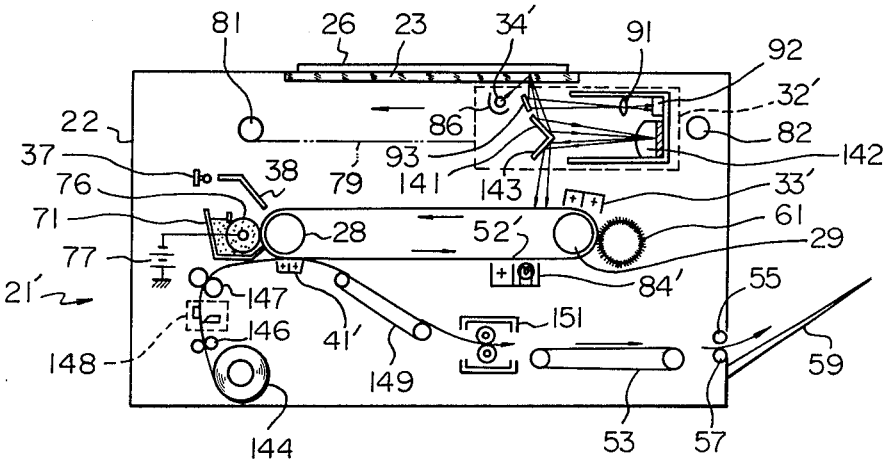
Fig. 10
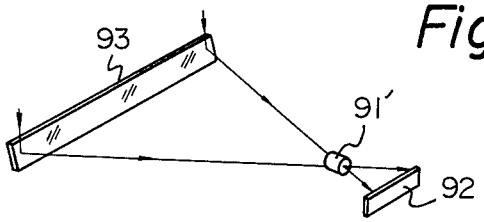

AC 100V
33
34
143
76
37"
+V
44
46
47
48
B4
A4
133
96"
97"
98"
136
132
135
131
134
141
H V SOURCE
142
LAMP REG.
77
BIAS VOLTAGE SOURCE
DISPLAY
130
123
PORT 0
PORT 1
8022 MICROPROCESSOR
124
92
+V
126
127
121

ELECTROSTATIC COPYING APPARATUS

BACKGROUND OF THE INVENTION

The present invention relates to an improved electrostatic copying apparatus. Such an apparatus comprises a photoconductive belt which is electrostatically charged and radiated with a light image while held stationary. This results in the formation of an electrostatic image which is developed with a toner substance to form a toner image which is transferred and fixed to a copy sheet.

In order to produce copies which are identical to the original documents, it is necessary to optimally adjust various operating parameters such as developing bias voltage and the like in accordance with the characteristics of the document. Generally, the developing bias voltage will vary in accordance with the optical density and contrast of the document.

In the type of copying apparatus to which the present invention relates, prior art attempts to optimally adjust the developing bias voltage include prescanning or sensing the entire document to determine the optical density pattern and adjusting the bias voltage in accordance with the overall density and contrast of the pattern. However, this involves the drawback that the prescanning requires an additional amount of time and therefore significantly reduces the copying speed. Also, the life of the illumination lamp is decreased and heat generation and power consumption are increased.

Another expedient is to sense the optical density of the leading edge portion of the document during scanning and adjust the bias voltage in accordance therewith. However, the leading edge portion of the document may vary considerably from the remainder of the document and the bias voltage may be adjusted erroneously.

Other problems inherent in prior art copying apparatus include unnecessary deterioration of the belt and overloading of a cleaning unit therefor due to toner adhering to non-image areas of the belt and the necessity of manually selecting a copy sheet size in accordance with the size of the original document.

SUMMARY OF THE INVENTION

An electrostatic copying apparatus embodying the present invention includes a photoconductive belt, charging means for forming an electrostatic charge on the belt, imaging means for scanning an original document and radiating a light image of the document on the belt to form an electrostatic image while the belt is held stationary and developing means for applying toner to the belt to develop the electrostatic image into a toner image, and is characterized by comprising sensor means movable integrally with the imaging means for sensing an optical density pattern of the document and producing electrical signals corresponding thereto, computing means for computing a predetermined operating parameter of a unit of the apparatus which is to be controlled after completion of the scanning operation in response to the electrical signals, and control means for controlling the unit to operate in accordance with the computed parameter.

In accordance with the present invention, the optical density pattern of an original document is sensed during scanning movement for radiating a light image of the document onto a photoconductive belt which is held stationary during the scanning. Operating parameters of the apparatus which are to be controlled after completion of scanning are computed as functions of the sensed pattern. Copy sheets of different sizes are provided, and the copy sheet size is selected to be equal to the sensed width of the document. Illumination lamps are selectively energized to discharge non-image portions of the belt between scanning and developing in accordance with the sensed dimensions of the document. A developing bias voltage is controlled in accordance with sensed document density and contrast.

It is an object of the present invention to optimally adjust a developing bias voltage and the like in accordance with a sensed density pattern of an entire original document without reducing the operating speed of an electrostatic copying apparatus.

It is another object of the present invention to provide an electrostatic copying apparatus comprising means for automatically preventing adherence of toner to non-image areas of a photoconductive belt and thereby unnecessary deterioration of the belt and overloading of a cleaning unit for the belt.

It is another object of the present invention to automatically select a copy sheet size as being equal to a sensed size of an original document, thereby reducing operator effort.

It is another object of the present invention to provide a generally improved electrostatic copying apparatus.

Other objects, together with the foregoing, are attained in the embodiments described in the following description and illustrated in the accompanying drawing.

BRIEF DESCRIPTION OF THE DRAWING

FIG. 2 is a perspective view of an imaging and sensing means of the apparatus;

FIG. 3 is a schematic side elevation of a modified imaging and sensing means;

FIG. 4 is a perspective view of an illumination unit of the apparatus;

FIG. 8 is a schematic diagram illustrating the operation of the illumination unit;

FIG. 9 is a schematic side elevation of a second electrostatic copying machine embodying the present invention;

FIG. 10 is a perspective view of sensing means of the apparatus of FIG. 9;

DESCRIPTION OF THE PREFERRED EMBODIMENTS

While the electrostatic copying apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
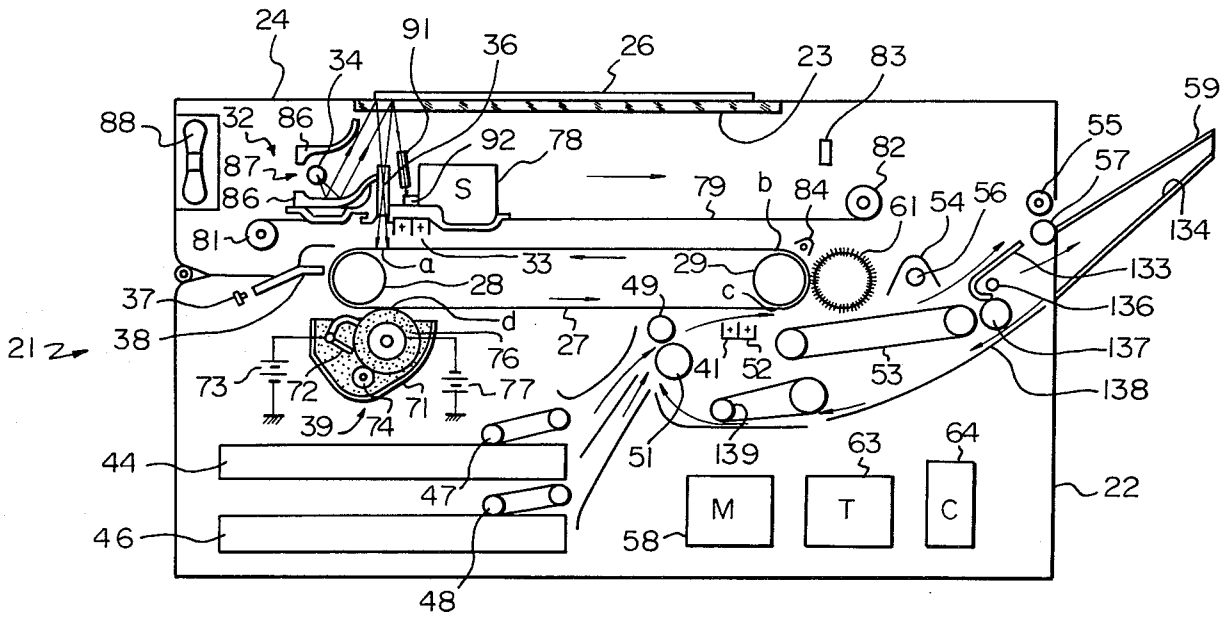
FIG. 1 is a schematic side elevation of an electrostatic copying machine or apparatus embodying the present invention.

Referring now to FIG. 1 of the drawing, an electrostatic copying machine 21 comprises a housing 22 and a transparent glass platen 23 provided at the upper surface of a cover 24 of the housing 22. An original document 26 which is to be electrostatically reproduced is placed face down on the platen 23.

A photoconductive endless belt 27 is trained around parallel first and second rollers 28 and 29 respectively below the platen 23. The outer surface of the belt 27 is coated with an OPC, selenium or similar photoconductive substance with the upper run of the belt 27 being parallel to the platen 23. An imaging and charging unit 32 comprising a corona charging unit 33, a light source 34 and an optical focussing element 36 in the form of an optical fiber array is moved rightwardly from the position shown to form an electrostatic image of the document 26 on the belt 27. This operation is performed while the belt 27 is held stationary. A light source or illumination lamp unit 37 and guide 38 are provided adjacent to the roller 28 to discharge portions of the belt 27 which are not used to form the electrostatic image, such as peripheral edge areas, to prevent toner from adhering to these areas. Rotation of the belt 27 in the counterclockwise direction after imaging causes the belt 27 move around the first roller 28. A developing unit 39 develops the electrostatic image to produce a toner image. A transfer charger 41 is disposed adjacent to the roller 29. A top copy sheet is fed from a stack in a cassette 44 or 46 by a feed roller unit 47 or 48 and register rollers 49 and 51 into engagement with the belt 27 as it moves around the roller 29. The copy sheet is fed at the same surface speed as the belt 27 with the leading edge of the copy sheet being in register with the leading edge of the toner image on the belt 27. A discharging unit 52 discharges the belt 27 after toner image transfer. The copy sheet advances onto a conveyor belt 53. A fixing unit 54 comprising an Xenon flash tube 56 fixes the toner image to the copy sheet. The conveyor belt 53, which is rotated clockwise, conveys the finished copy via feed rollers 55 and 57 into a discharge tray 59 from which the copy is removed for use. A cleaning unit 61 comprising a fur brush is illustrated for removing residual toner from the belt 27. Further illustrated are a drive motor 58, a transformer 63 for the motor 58 and a capacitor 64 for the flash tube 56.

The length of the upper run of the belt 27 on which the electrostatic image is formed is equal to L1, which is the length of the maximum sized original document 26 which is to be copied. The length of the upper run L1 is designated at its opposite ends by the characters a and b respectively. A similar length L2 which is equal to L1 is designated on the lower run of the belt 27 between points c and d. Although the entire outer surface of the belt 27 is preferably photoconductive and available for use in image formation, in accordance with the following description, images are only formed on the lengths L1 and L2. As the belt 27 rotates by one half revolution, the length L1 occupies the position which was formally occupied by L2 and vice-versa.

By multiple copying it is meant that a plurality of copies are to be made in succession, either of the same original document or of different original documents. In a single copying operation, only one copy is to be made of a single original document.

The first step of a multiple copy process is to hold the belt 27 stationary and move the imaging unit 32 rightwardly for scanning. The charger 33 forms a uniform electrostatic image on the length L1 while a light image of the document 26 illuminated by the light source 34 is progressively radiated onto the length L1 by the focussing element 36. The light image causes localized photoconduction of the belt 27 and the formation of an electrostatic image of the document 26 thereon.

In the next step of the process, the belt 27 is driven for one half revolution in the counterclockwise direction while the imaging unit 32 is rapidly returned to the position shown. During this operation, the length L1 is moved around the roller 28 to occupy the position previously occupied by the length L2, and the electrostatic image is developed by the developing unit 39.

In the next step, the belt 27 is held stationary and the imaging unit 32 is moved rightwardly to form an electrostatic image of the same or another original document in the length L2.

In the next step, the belt 27 is driven for one half revolution and the imaging unit 32 is returned to the position shown. During this operation, the first toner image in the length L1 is transferred to the copy sheet by the transfer charger 41 and the second electrostatic image in the length L2 is developed by the developing unit 39.

In the next step, the belt 27 is stopped and the imaging unit 32 is moved rightwardly to form a third electrostatic image in the length L1. In the last step, the belt 27 is driven for one half revolution and the imaging unit 32 is returned to the position shown. During this operation, the second toner image in the length L2 is transferred to the copy sheet while the third electrostatic image in the length L1 is developed.

This operations are repeated until all desired copies are produced. For the last copy, the belt 27 is driven for one complete revolution after imaging so that the last electrostatic image will be developed during the first one half revolution and the resulting toner image transferred to the copy sheet during the second half revolution. During continuous operation, each one half revolution of the belt 27 results in development of one toner image and transfer of a prior toner image.

For making a single copy, the procedure is the same as for making the last copy in a multiple copying operation. The belt 27 is held stationary while the electrostatic image of the document is formed, and then driven for one complete revolution.

The developing unit 39 comprises a developing tank 71 which contains, for example, liquid toner. A blade 72 biased to a positive polarity by a power source 73 charges the toner to a positive polarity. The toner is applied to the belt 27 by a roller 76 which lightly engages the belt 27 and is rotated counterclockwise. A bias voltage source 77 applies a negative bias voltage to the roller 76 which is typically formed of a metal shaft and a conductive spongy roller fixed to the shaft. A roller 74 removes excess toner from the roller 76 and is rotated in the same direction thereas. It is assumed that the electrostatic image on the belt 27 has a negative polarity, so that the positively charged toner adheres thereto.

A power supply 78 for the charging unit 33 moves integrally therewith. A curtain 79 is trained around rollers 81 and 82 and spring biased so as to be maintained taut. An opening is formed through the curtain 79 to allow the light image from the focussing element 36 to pass therethrough. However, all other light is prevented by the curtain 79 from reaching the belt 27. Further illustrated is a microswitch 83 or similar sensing element which is closed when the imaging unit 32 reaches its rightmost position. In response, clutches (not shown) connecting the motor 58 to drive means (not shown) for the imaging unit 32 are changed over to cause the imaging unit 32 and integral units to reverse direction and return to the position shown at high speed. A discharge lamp 84 discharges the belt 27 after removal of residual toner by the brush 61.

Referring also to FIG. 2, the imaging unit comprises a reflector 86 for the lamp or light source 36. The reflector 86 is formed with a rear cutout 87 so that the lamp 36 may be cooled by a blower 88. The focussing element 36 is typically a focussing optical fiber array which is commercially available under the tradename SELFOC. A light image of a linear portion of the document 26 is focussed on the belt 27 by the element 36 as indicated by hatching. Scanning movement of the imaging unit 32 results in the progressive radiation of an entire light image of the document 26 on the belt 27 while the belt 27 is maintained stationary.

In accordance with an important feature of the present invention, another optical fiber array 91 is provided to focus a light image of the same linear portion of the document 26 onto a photosensor array 92. The array 91 may be a SELFOC unit whereas the array 92 comprises a CCD photosensor array or a plurality of phototransistors. A separate light source for the array 91 is not necessary since the area sensed by the array 91 is illuminated by the lamp 34.

A modified arrangement of the imaging unit 32 is illustrated in FIG. 3 and designated as 32'. In FIG. 3, the array 91 is mounted horizontally on top of the power supply 78 and a mirror 93 provided to reflect the light image horizontally into the array 91.

With the arrangement of FIG. 2 or FIG. 3, the array 92 produces output electrical signals representing the entire optical density pattern of the document 26. This pattern is analysed as will be described in detail below by computing means and the results of the computation used to automatically control various operating parameters of the apparatus 21.

FIG. 4 illustrates the illumination unit 37 and guide in greater detail. The unit 37 comprises a support 94 on which are mounted three miniature bulbs 96, two miniature bulbs 97 and eight miniature bulbs 98 in a row. All of the bulbs 96, 97 and 98 are connected to a common line 101. The other ends of the filaments of the bulbs 96 are connected to a line 102. In a similar manner, the bulbs 97 are connected to a line 103 and the bulbs 98 are connected to a line 104.

The guide 38 is typically in the form of an optical fiber array. In order to focus the light from the bulbs 96, 97 and 98 onto the belt 27, the ends of the fibers of the array 38 facing the bulbs 96, 97 and 98 are concave whereas the ends of the fibers of the array 38 facing the belt 27 are convex. Light from the bulbs 96, 97 and 98 causes dissipation of all electrostatic charge in the corresponding areas of the belt 27.

Figure 5:
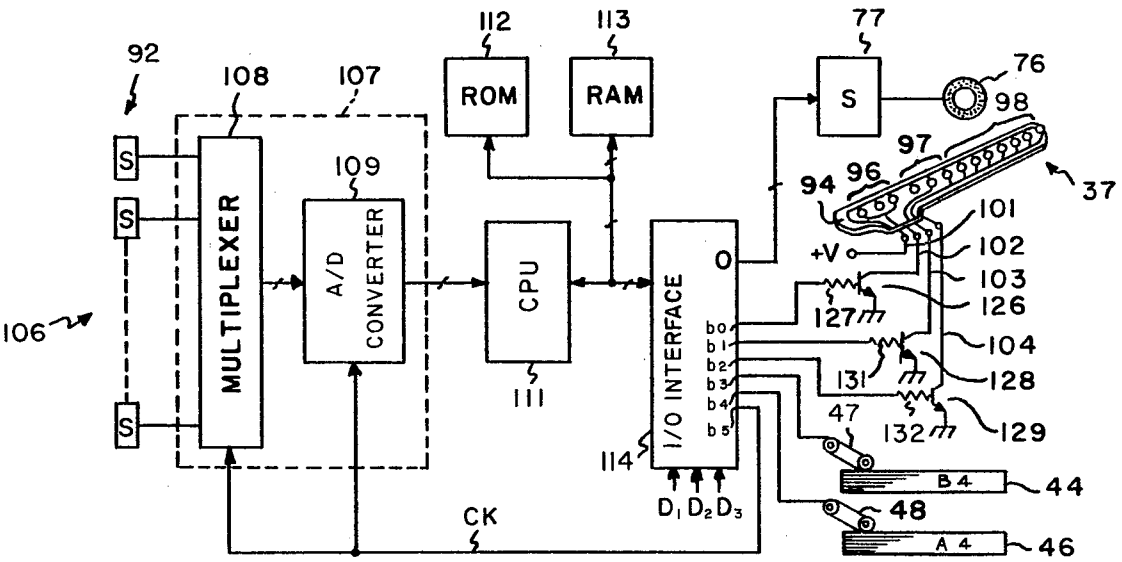
FIG. 5 is a schematic diagram, partially in block form, of a control means of the apparatus.

A control means for the apparatus 21 is illustrated in FIG. 5 and designated as 106. The control means 106 comprises an input interface 107 which may be embodied by the National Semiconductor model ADCO816C which is commercially available as an off the shelf item. The interface 107 comprises a multiplexer 108 which is connected between the photosensor array 92 and an A/D converter 109.

The individual photosensor elements of the array 92 are sequentially or serially scanned in response to clock pulses CK and produce analog outputs corresponding to incident light and thereby the optical density of the document 26. The signals are serially fed through the multiplexer 108 and converted to digital form by the converter 109.

Figure 6:
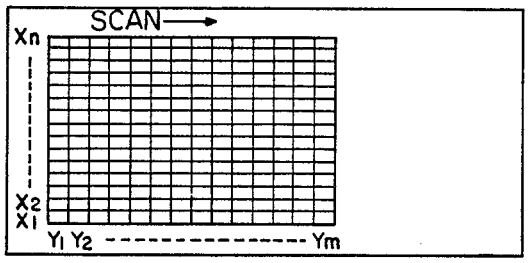
FIG. 6 is a schematic diagram of an orthogonal scanning pattern of the apparatus.

In this manner, the entire surface of the document 26 is scanned in an orthogonal pattern. The arrangement is shown in FIG. 6. Signals x1 to xn are produced in a vertical column and are the respective outputs of the elements of the array 92. These signals are represented by a group y1 in FIG. 7. Then, after the imaging unit 32 has moved rightwardly by an incremental distance, the elements of the array 92 are scanned again and produce signals x1 to xn of a group y2. The total number of signals produced by the array 92 is n·m where n is the number of elements in the array 92 and m is the number of incremental distances in the scanning range of the imaging unit 32. It will be understood that the imaging unit 32 is moved continuously and the array 92 is scanned intermittently.

The computing means 106 further comprises a central processing unit 111, a read only memory 112 for storing an operating program and a random access memory 113 for storing intermediate results and data. The CPU 111 is connected to an input-output interface 114. Data from sensors (not shown) such as ambient temperature and humidity, toner density and copy sheet type are fed to the CPU 111 via the interface 114 through ports D1, D2 and D3.

The CPU 111 is constructed to store the sensed image pattern in the RAM 113 and compute various parameters for controlling subsequent operations of the apparatus 21 in accordance with the nature of the pattern. The developing bias voltage applied to the roller 76 by the source 77 is critical to image quality. The CPU 111 is constructed to compute an optimum developing bias voltage as a function of the sensed density and contrast of the document 26 as represented by the signals. The particular computational method is not the particular subject matter of the present invention. A method which has been determined to produce good results is disclosed in U.S. Pat. No. 4,153,364 which is incorporated herein by reference. The CPU 111 controls the source 77 to apply the optimal developing bias voltage to the roller 76 through a port 0 of the interface 114.

The CPU 111 may feed a three bit binary control signal to the source 77 which comprises a decoder (not shown) for decoding the control signal and applying a bias voltage to the roller 76 in accordance therewith. A logic table of the bias voltage control is given in the following table.

| Control Signal | | | Bias Voltage |
|---|---|---|---|
| 0 | 0 | 0 | 0 |
| 0 | 0 | 1 | 300 |
| 0 | 1 | 0 | 350 |
| 0 | 1 | 1 | 400 |
| 1 | 0 | 0 | 450 |
| 1 | 0 | 1 | 500 |
| 1 | 1 | 0 | 550 |
| 1 | 1 | 1 | 600 |

The CPU 111 may also compute whether the document is a photographic document (continuous tone) or a printed document (two tone). This may be determined by computing the average length of dark image lines in the x, y or both the x and y directions. If the average length is from 0.1 to several tens of millimeters, the document is taken to be a printed document. If, however, the average length is over several tens of millimeters, the document is taken to be a photographic document. In this case, the bias voltage may be limited to about 500 V for printed documents and to about 300 V for photographic documents.

The CPU 111 also determines the size of the original document 26 by detecting the areas of constant photosensor output, with a corner of the document 26 aligned with a corner of the platen 23 as shown in FIG. 8 at 116. If the document 26 is size B4, the CPU 111 will energize the roller unit 47 at a proper timing through a port b3. If the document is A4, the CPU 111 will similarly energize the roller unit 48 through a port b4. The clock pulses CK are fed to the interface 107 through a port b5.

A port b0 of the interface 114 is connected to the base of an NPN bipolar transistor 126 through an input resistor 127. The emitter of the transistor 126 is grounded whereas the collector of the transistor 126 is connected to the line 102. Ports b1 and b2 are similarly connected to the lines 103 and 104 via transistors 128 and 129 and resistors 131 and 132. The line 101 is connected to a source +V.

If the document 26 is size B5, the signals corresponding to an area 117-119-125-124-120-121 will all be the same, corresponding to the density of a cover plate or presser plate (not shown) for the platen 26. Thus, the CPU 111 will initially produce high outputs from the ports b0 and b1 to turn on the transistors 126 and 128. This lights the lamps 96 and 97 and discharges a non-image area of the belt 27 corresponding to 121-110-124-120. The lamps 96 and 97 may be lighted just as the leading edge of the electrostatic image on belt 27 reaches the end of the guide 38. When the trailing edge of the electrostatic image reaches the guide 38, the bulbs 98 are turned on in addition to the bulbs 96 and 97 to discharge an area 117-119-125-110. In this manner, the entire non-image area of the belt 27 is automatically discharged to prevent excessive fatigue of the belt 27 and overloading of the brush unit 61.

For an A4 size document, only the bulbs 96 are initially lighted to discharge an area 122-123-115-124. As the trailing edge of the electrostatic image reaches the guide 38, all of the bulbs 96, 97 and 98 are lighted. If the document 26 is of size B4, none of the bulbs 96, 97 and 98 are ever lighted.

The apparatus 21 is also capable of copying on both sides of a copy sheet. This is accomplished by initially moving a deflection pawl 133 counterclockwise from the position shown. In the illustrated position, the pawl 133 guides the copy sheet into the bite of the feed rollers 55 and 57 which discharge the same into the tray 59. However, with the pawl 13 in the non-illustrated counterclockwise position, the copy sheet, after copying on the first side thereof, is guided by the pawl 133 into the bite of feed rollers 136 and 137 which feed the copy sheet into a tunnel 134 formed in the tray 59. When the trailing edge of the copy sheet clears the feed rollers 136 and 137, the copy sheet is caused by gravity to slide down a guide 138 into the bite of a feed roller unit 139. It will be noted that copy sheets may be manually inserted into the apparatus 21 via the tunnel 134.

The feed roller unit 139 feeds the copy sheet into the bite of the register rollers 49 and 51 which feed the copy sheet to the belt 27 in register with a second toner image. Due to the fact that the copy sheet is inverted during movement into and out of the tunnel 134, the second toner image is transferred onto the second or back side of the copy sheet, thereby attaining copying on both sides of the sheet. Naturally, the second toner image is of a back side of an original document, the front side of which was copied on the front side of the copy sheet, or another original document.

The apparatus 21 is also capable of optimally controlling the intensity of illumination of the document 26 where desired by means of prescanning the document prior to imaging exposure. This is desirable where especially excellent copy quality is required and copying speed is not particularly important and also where a large number of copies are to be made of the same original document. In the latter case, prescanning is required only once, before making the first copy.

It is also possible to connect another output port of the interface 114 to the transfer charger 41 to control the transfer charging voltage in accordance with the sensed image pattern.

The construction of the control means 106 may be greatly simplified by embodying the CPU 111, ROM 112, RAM 113 and interface 114 by a one-chip microprocessor such as the INTEL 8022.

FIGS. 9 and 10 illustrate another apparatus embodying the present invention which is designated as 21'. Like elements are designated by the same reference numerals whereas corresponding but modified elements are designated by the same reference numerals primed.

The apparatus 21' differs from the apparatus 21 in the following respects.

1. The charging unit 33' is fixed in position adjacent to the roller 29 and charging is performed while the belt 27 is moved. The belt 27 is thereafter maintained stationary for the imaging exposure.

2. The imaging means 32 is replaced by an imaging means 32' comprising a mirror 141, an optical converging lens 142 having a rear reflecting surface and a mirror 143. Scanning is performed by moving the imaging means 32' leftwardly while the belt 27 is maintained stationary.

3. The optical fiber array 91 is replaced with an optical converging lens in the arrangement of FIG. 3. This is best illustrated in FIG. 10.

4. The sheet cassettes 44 and 46 are replaced by a copy sheet roll 144. Paper from the roll 144 is fed to the belt 27 by feed rollers 146 and 147 and cut to the required size by a cutter 148. A conveyor belt 149 conveys the copy sheet bearing the toner image to a thermal fixing unit 151 from which the finished copy is discharged onto the tray 59 by the conveyor belt 53 and discharge rollers 55 and 57.

5. The transfer charger 41' and discharging unit 52' are separated from each other and the discharge lamp 84' is located adjacent to the discharging unit 52'.

The cutter 148 is controlled to cut the paper 144 to the required size based on the sensed size of the document 26.

Due to the fact that the light image intensity at the edges of the image is lower than at the central portion thereof as an unavoidable result of using the optical converging element or lens 142, the lamp 34' is costructed to produce more light at the edges of the document 26 for compensation. For this reason, it is desirable to use the optical focussing element 91' so that the image intensity distribution of a reduced size light image radiated onto the photosensor array 92 will be the same as the light image radiated onto the belt 27. In other words, where an optical fiber array is used as the main imaging element, another optical fiber array of similar construction is used for the sensor focussing element. Where the main imaging element is an optical lens, a similar optical lens is used for the sensor focussing element.

It will be noted that the CPU 111 functions to determine the document size by determining the areas of identical optical density in the optical image density pattern. Thus, the copy sheet size and non-image area illumination will be correct even if a cover or presser plate of the apparatus 21 is not used or closed.

Figure 11:
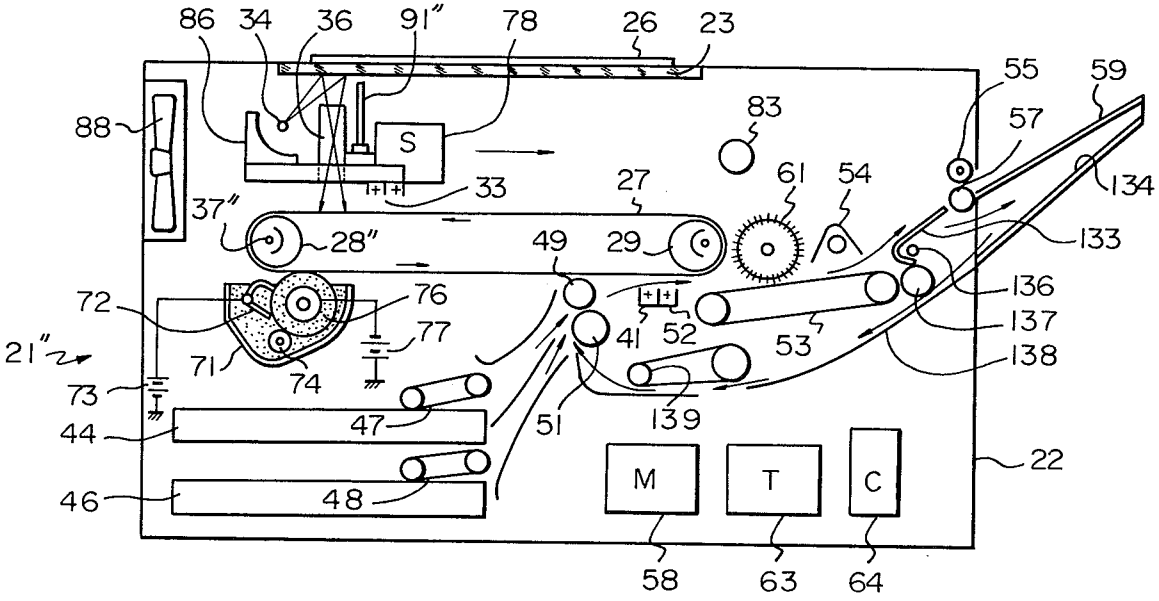
FIG. 11 is a schematic side elevation of a third electrostatic copying machine embodying the present invention.
Figure 12:
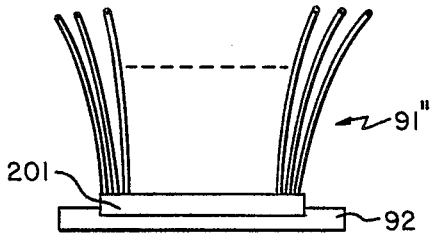
FIG. 12 is a perspective view of sensing means of the apparatus of FIG. 11.

FIG. 11 illustrates another copying apparatus embodying the present invention which is generally designated as 21''. The apparatus 21'' differs from the apparatus 21 in the configuration of the optical fiber array 91'' which is shown in FIG. 12. The array 91'' may be focussing or non-focussing.

Figure 13:
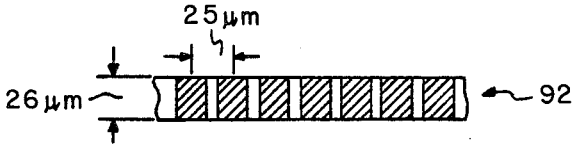
FIG. 13 is a schematic view of a photosensor arrangement of the sensing means of FIG. 12.
Figure 14:
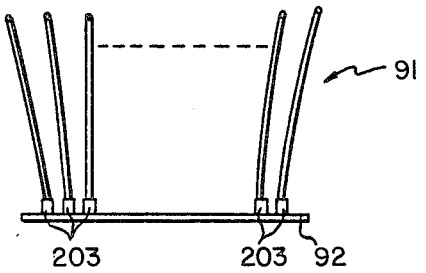
FIG. 14 is a schematic view of an alternative sensing means of the apparatus of FIG. 11.

As best seen in FIG. 12, the individual fibers of the array 91'' come together at a connector block 201 located immediately adjacent to the photosensor array 92 but fan out so as to be symmetrically separated from each other adjacent to the plate 26. FIG. 13 illustrates the spacing of the photosensor elements of the array 92 which are designated as 202 in a commercially available CCD photosensor array. FIG. 14 shows an alternative arrangement in which the ends of the individual fibers of the array 91'' are fixed to the array 92 by individual connector blocks 203.

Figure 7:
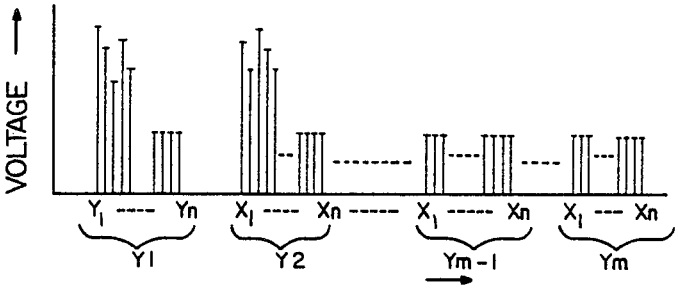
FIG. 7 is a representative timing diagram of electrical signals produced by the sensing means.
Figure 15:
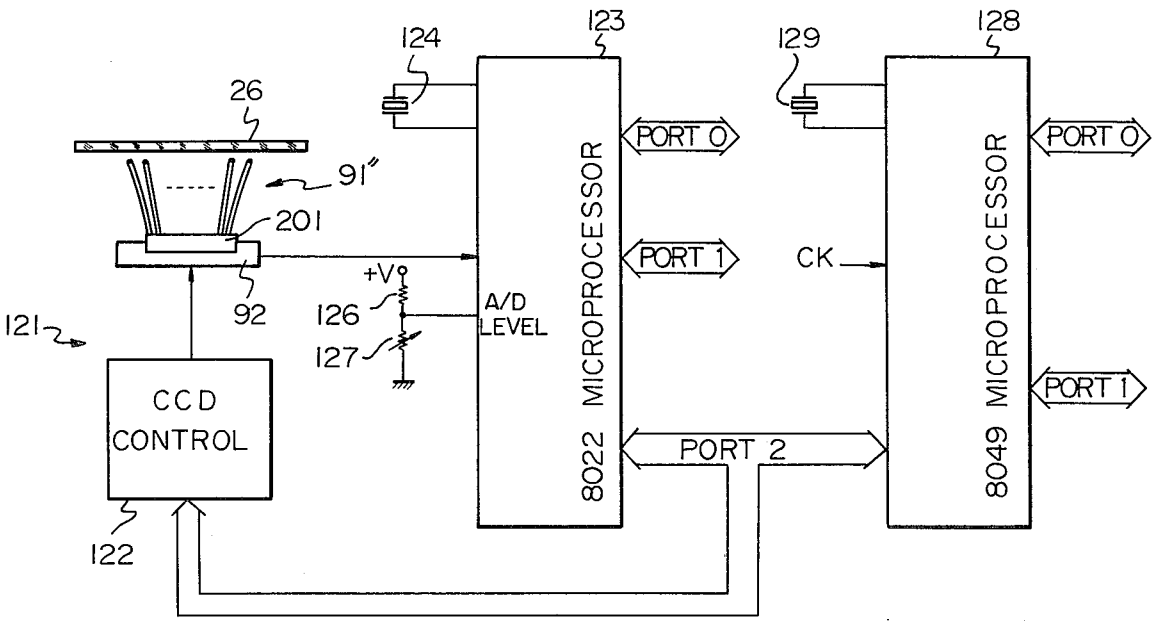
FIG. 15 is a schematic diagram, partially in block form, of a control means of the apparatus of FIG. 11.

Referring now to FIG. 15, a control means 121 for the apparatus 21'' comprises a CCD control unit 122 which causes the elements 202 of the array 92 to serially self-scan at intervals corresponding to y in FIGS. 6 and 7. The analog output signals of the array 92 are fed to a microprocessor 123 which has a clock frequency controlled by a crystal 124. An analog to digital conversion level may be manually set by means of a resistor 126 and variable resistor 127 to manually adjust the copy density.

The microprocessor 123 may be preferably embodied by the INTEL 8022, which is an eight bit, one chip microprocessor comprising a CPU, I/O interface, A/D converter, A/D conversion level adjustment and comparator for a touch sensor. The program memory ROM has a capacity of two kilobytes.

The control means 121 further comprises another microprocessor 128 which has a clock frequency controlled by a crystal 129. The microprocessor 128 is preferably embodied by the INTEL 8049 which is similar to the 8022 except that it does not comprise an A/D converter or touch sensor comparator and is used for controlling the overall operation of the apparatus 21''. The CCD control 122 comprises means for producing shift clock pulses for the array 92 in addition to transfer and load clock pulses and receives timing control signals from a port 2 of the microprocessor 123.

Figure 16:
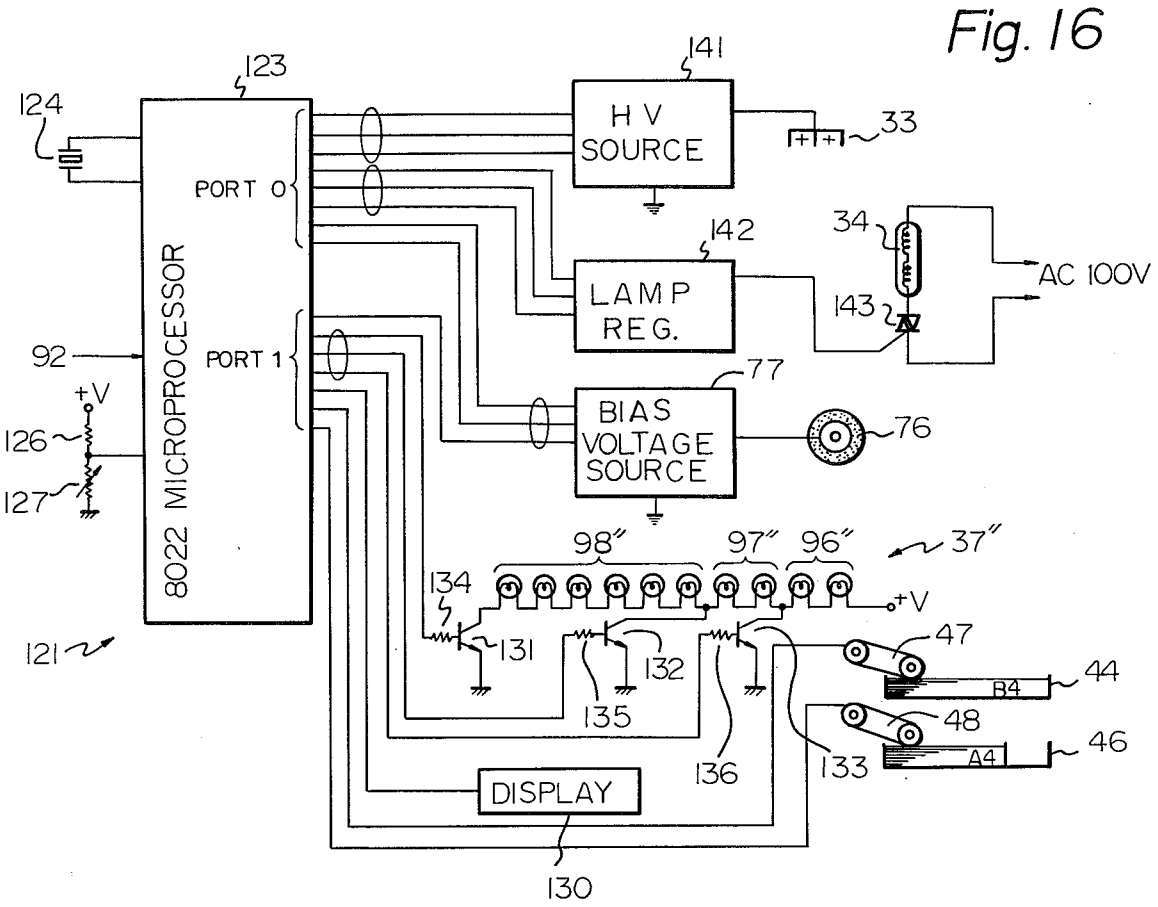
FIG. 16 is a schematic diagram, partially in block form, further illustrating the control means of the apparatus of FIG. 11.

FIG. 16 illustrates the manner in which various operating parameters of the apparatus 21'' are controlled by the control means 121 according to the sensed density pattern. The developing bias voltage and copy sheet size selection are controlled in the manner described above with reference to the apparatus 21. A display 130 may be energized when the size of the document 26 is non-standard.

A modified illumination unit 37'' comprises two bulbs 96'', two bulbs 97'' and six bulbs 98'' which are all connected in series between a source +V and the collector of a transistor 131. The bulbs 96'' and 97'' are connected in series between the source +V and the collector of a transistor 132. The bulbs 96'' are connected in series between the source +V and the collector of a transistor 133. The emitters of the transistors 131, 132 and 133 are grounded while the bases of the transistors 131, 132 and 133 are connected to different output port lines of port 1 of the microprocessor 123 through input resistors 134, 135 and 136 respectively.

For B5 size, the transistors 132 and 133 are initially turned on to light the bulbs 96'' and 97''. For A4 size, the bulbs 96'' are initially lighted. None of the bulbs 96'', 97'' and 98'' are lighted for B4 size. All of the bulbs 96'', 97'' and 98'' are lighted for B5 and A4 size when the trailing edge of the electrostatic image reaches unit 37''.

In accordance with an important feature of the present invention, a roller 28'' is transparent and the unit 37'' is mounted inside the roller 38''.

Although the voltage applied to the charger 33 and the intensity of illumination of the lamp 34 cannot be optimally adjusted without prescanning, it is often desirable to obtain high copy quality where time is not so important. Prescanning may be accomplished without a copying operation or the prescanning may be performed simultaneously with a copying operation and the results of the prescanning used to control the charger 33 and lamp 34 for second and subsequent copies.

The following table illustrates control signals produced by the microprocessor 123 to control the voltage of the charger 33 and intensity of the lamp 34 by means of a high voltage source 141 for the charger 33 and a lamp regulator 142 and triac 143 for the lamp 34''. The units 141 and 142 comprise three bit decoders as described with reference to the source 77.

| Control Signal | | | Charging Voltage (KV) | Lamp Voltage (V) |
|---|---|---|---|---|
| 0 | 0 | 0 | 0 | 0 |
| 0 | 0 | 1 | 5.6 | 55 |
| 0 | 1 | 0 | 5.8 | 60 |
| 0 | 1 | 1 | 6.0 | 65 |
| 1 | 0 | 0 | 6.2 | 70 |
| 1 | 0 | 1 | 6.4 | 75 |
| 1 | 1 | 0 | 6.6 | 80 |
| 1 | 1 | 1 | 6.8 | 85 |

In summary, it will be seen that the present invention overcomes the drawbacks of the prior art and provides an electrostatic copying apparatus which features improved copy quality without a decrease in copying speed. Various modifications will become possible for those skilled in the art after receiving the teachings of the present disclosure without departing from the scope thereof.

What is claimed is:

1. An electrostatic copying apparatus including a photoconductive belt, charging means for forming an electrostatic charge on the belt, imaging means for performing a scanning operation by scanning an original document and radiating a light image of the document on the belt to form an electrostatic image while the belt is held stationary and developing means for applying toner to the belt to develop the electrostatic image into a toner image, characterized by comprising:

sensor means movable integrally with the imaging means for sensing an optical density pattern of the document and producing electrical signals corresponding thereto;

computing means for computing a predetermined operating parameter of a unit of the apparatus which is to be controlled after completion of the scanning operation in response to the electrical signals; and control means for controlling the unit to operate in accordance with the computed parameter;

the unit being an illumination means for radiating light onto non-image portions of the belt between the scanning and developing operations, the parameter being a timing of operation of the illumination means; and first and second rollers, the belt being trained around the first and second rollers, the electrostatic image on the belt moving around the first roller before moving around the second roller, the first roller being transparent, the illumination means being disposed inside the first roller.

2. An apparatus as in claim 1, in which the control means is further constructed to control a developing bias voltage of the developing means.

3. An apparatus as in claim 1, further comprising a copy sheet feed means for selectively feeding copy sheets of different sized to the belt for toner image transfer thereto, the control means being further constructed to select a size of the copy sheets, the computing means computing the copy sheet size as being equal to a computed size of the document.

4. An apparatus as in claim 1, in which the illumination means comprises a row of light sources arranged perpendicular to a direction of rotation of the belt, the parameter further comprising indications of which of the light sources are to be energized.

5. An apparatus as in claim 2, in which the computing means is further constructed to compute an indication of whether the document is a two tone document or a continuous tone document, the control means controlling the bias voltage in accordance with the indication.

6. An apparatus as in claim 1, in which the imaging means comprises a coverging lens for focussing the light image of the document onto the belt, the sensor means comprising photosensor means and a converging lens for focussing the light image of the document onto the photosensor means.

7. An apparatus as in claim 1, in which the imaging means comprises a first optical fiber array for focussing the light image of the document onto the belt, the sensor means comprising photosensor means and second optical fiber means for conducting the light image of the document onto the photosensor means.

8. An apparatus as in claim 7, in which the second optical fiber means is a focussing optical fiber means.

9. An apparatus as in claim 7, in which the second optical fiber means is a non-focussing optical fiber means.

10. An apparatus as in claim 8, in which the first and second optical fiber means and the photosensor means comprise linear arrays.

11. An apparatus as in claim 9, in which the first and second optical fiber means and the photosensor means comprise linear arrays.

12. An apparatus as in claim 1, in which the sensor means is constructed to sense the optical density pattern of the document in an orthogonal pattern.

13. An apparatus as in claim 1, in which the sensor means comprises a linear photosensor array.

14. An apparatus as in claim 1, further comprising a light source integrally movable with the imaging means and the sensor means for illuminating a portion of the document which is simultaneously scanned by the scanning means and sensed by the sensor means.

15. An apparatus as in claim 1, in which the charging means is integrally movable with the imaging means and positioned ahead of the imaging means in a direction of movement thereof.

16. An apparatus as in claim 1, in which the charging means is fixed in position.

17. An apparatus as in claim 1, in which the illumination means comprises a row of light sources and a plurality of optical fibers conveying light from the light sources respectively to the belt.

18. An apparatus as in claim 1, in which ends of the optical fibers facing the light sources are concave whereas ends of the optical fibers facing the belt are convex.

* * * * *